US007536967B2

(12) United States Patent
Barber

(10) Patent No.: US 7,536,967 B2
(45) Date of Patent: May 26, 2009

(54) MARINE WATER CONVERSION

(76) Inventor: Gerald L. Barber, 410 Hudson Rd., Greenville, SC (US) 29601

( * ) Notice: Subject to any disclaimer, the term of this patent is extended or adjusted under 35 U.S.C. 154(b) by 549 days.

(21) Appl. No.: 11/343,144

(22) Filed: Jan. 30, 2006

(65) Prior Publication Data

US 2007/0084768 A1 Apr. 19, 2007

Related U.S. Application Data

(63) Continuation-in-part of application No. 11/253,247, filed on Oct. 18, 2005, now abandoned.

(51) Int. Cl.
*B63B 35/00* (2006.01)
*A01G 15/00* (2006.01)

(52) U.S. Cl. ..... 114/144 R; 114/144 A; 114/267; 114/382; 210/85; 210/91; 210/121; 210/143; 210/170.11; 210/242.1; 239/2.1; 239/14.1; 405/80; 405/303; 417/14; 417/278; 417/315; 417/320

(58) Field of Classification Search ..... 210/85, 210/91, 120, 121, 143, 170.05, 170.09, 170.11, 210/242.1, 242.2, 242.3, 747, 776; 239/2.1, 239/14.1; 261/77, 75; 405/52, 80, 303; 417/14, 417/53, 244, 245, 278, 315, 320; 60/221; 114/121, 144 A, 144 R, 267, 312, 330, 331, 114/333, 382
See application file for complete search history.

(56) References Cited

U.S. PATENT DOCUMENTS

| | | | | |
|---|---|---|---|---|
| 3,683,627 | A * | 8/1972 | Girden | 405/52 |
| 4,051,810 | A | 10/1977 | Breit | 119/3 |
| 4,107,240 | A * | 8/1978 | Verner et al. | 261/77 |
| 4,597,360 | A | 7/1986 | Johnson | 119/3 |
| 4,724,086 | A * | 2/1988 | Kortmann | 210/747 |
| 4,726,191 | A | 2/1988 | Kawamura | 60/641.7 |
| 5,106,230 | A | 4/1992 | Finley | 405/52 |
| 6,428,711 | B1 * | 8/2002 | Nakamura et al. | 210/747 |
| 2002/0008155 | A1 * | 1/2002 | Uram | 239/14.1 |
| 2002/0009338 | A1 * | 1/2002 | Blum et al. | 405/303 |
| 2005/0133612 | A1 * | 6/2005 | Uram | 239/2.1 |

* cited by examiner

*Primary Examiner*—Joseph W Drodge
(74) *Attorney, Agent, or Firm*—Nexsen Pruet, LLC; Charles L. Schwab

(57) ABSTRACT

A marine water conversion apparatus capable of pumping ocean surface water several hundred feel below the surface to cause sufficient cooler water to rise to the surface to prevent formation of or to moderate hurricanes. The apparatus is remotely controlled and includes a propulsion system for moving it to a new location or in predetermined patterns through use of a global positioning system and computerized controls. Power for driving the pumps may be provided by a wind turbine driven electric generator at the upper end of an upper tube section pivotally connected to a float tank on a vertical axis.

30 Claims, 11 Drawing Sheets

5
87
88
27
26
28
15
12'
71
61
51
62
52
53
63
54
64
74
16'
14
14'
82
83
81
84
17'
60
12
20
20
5

87
88
30
27
26
28
13
19
15
18'
12'
63
53
15'
55
65
14
16'
123
14
83
85
14'
95
17'
60
12

MARINE WATER CONVERSION

RELATED APPLICATIONS

This is a continuation-in-part of U.S. patent application Ser. No. 11/253,247 filed Oct. 18, 2005 for a Marine Water Conversion, the benefit of which is claimed.

BACKGROUND OF THE INVENTION

When the surface temperature of ocean water rises to near 80° F. hurricanes develop with great damage potential. Meteorologists monitor weather systems and conditions likely to develop into hurricanes and warnings are issued to those in the path of developing hurricanes. Never the less, lives are lost and catastrophic property damage is imparted by hurricanes.

SUMMARY OF THE INVENTION

This invention provides marine water conversion apparatus and a method for reducing the surface temperature of a part of the ocean where the surface temperature has reached, or is close to reaching, a level that is conducive to the formation of hurricanes. A floating apparatus is provided with large pumps which transfer a high volume of surface water several hundred feet below the ocean surface via a tube thereby creating a lava lamp effect body of warm water assisting cooler water below the removed surface water to rise to the surface. The apparatus is equipped with remotely controllable propulsion equipment for selectively positioning the apparatus geographically in the ocean through use of remote controls with a global positioning system. A computerized control system may include computer programs for moving the apparatus in a circular path or in a grid. In one embodiment of the invention, the apparatus includes a wind driven electric generator. The apparatus may also be used to alter current paths to clear harbors of accumulations of pollution. Use of the apparatus as described can cause nutrients at the bottom of the ocean to rise toward the surface, which is recognized as being beneficial to the fishing industry.

DETAILED DESCRIPTION OF THE DRAWINGS

The invention is illustrated in the accompanying drawings, in which.

DETAILED DESCRIPTION OF THE INVENTION

Figures 1, 2:
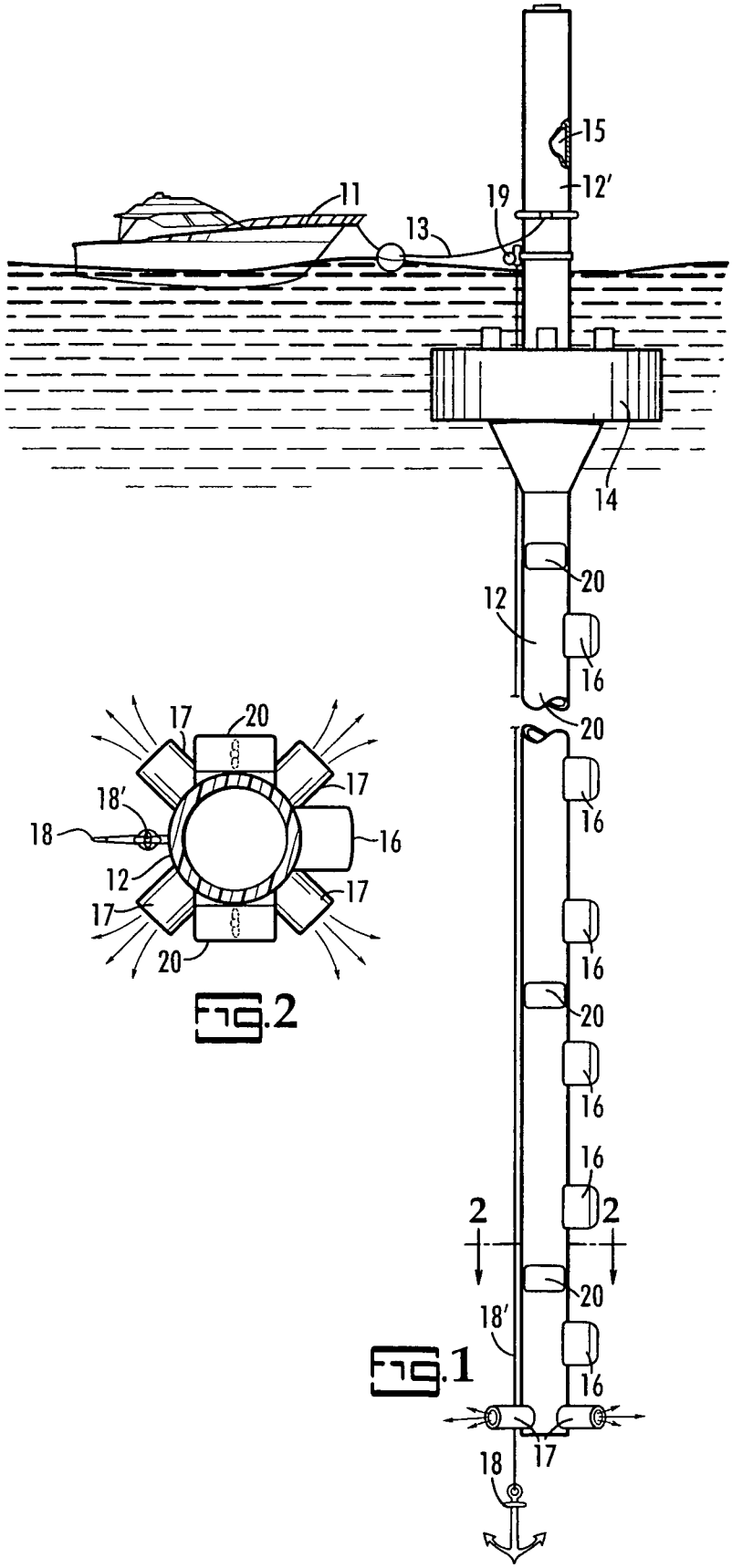
FIG. 1 is a side view of a first embodiment of the apparatus employed to pump surface water to a predetermined ocean depth.
FIG. 2 is a section taken on line 2-2 in FIG. 1.
Figure 5:
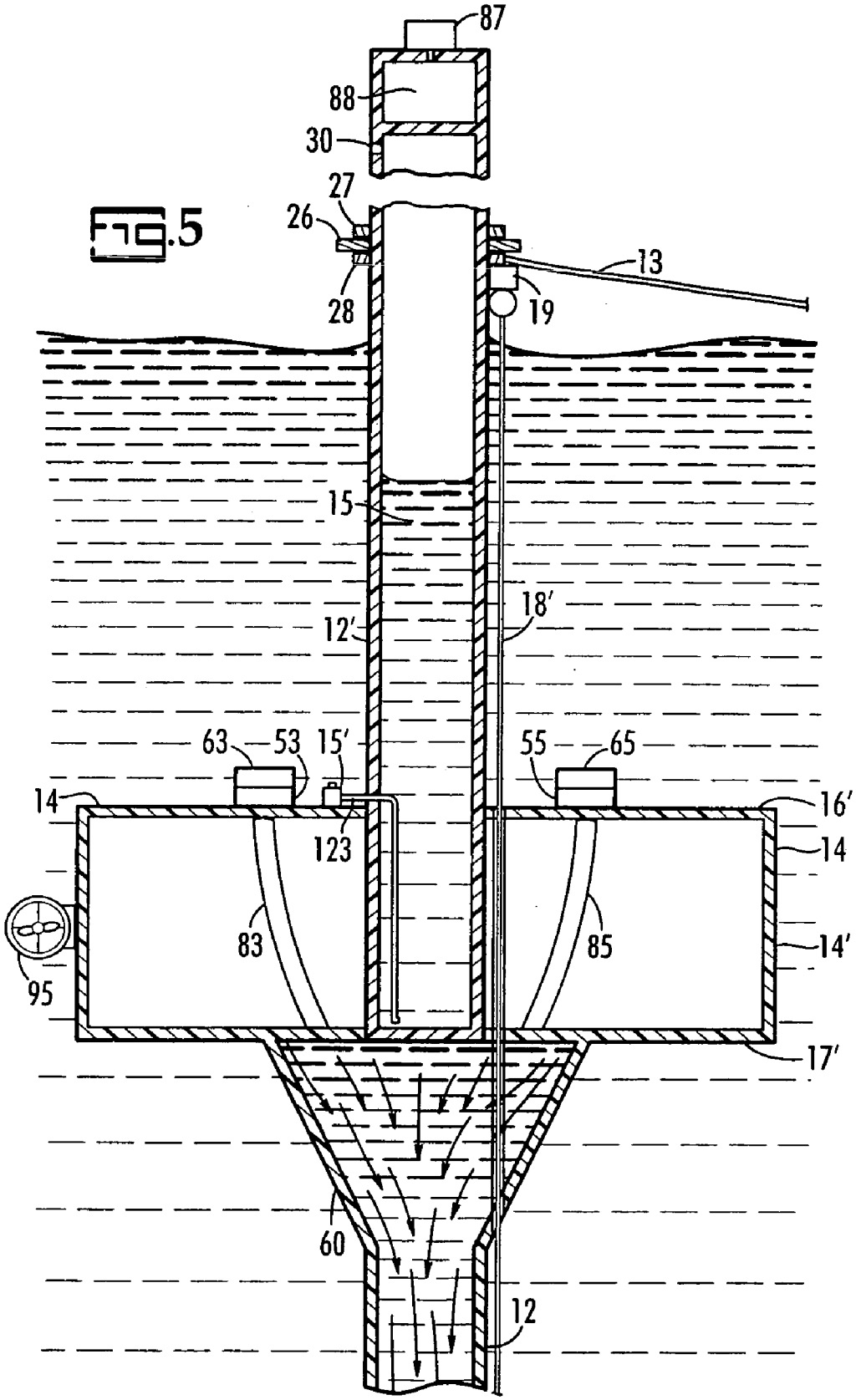
FIG. 5 is a section taken on line 5-5 in FIG. 4.
Figure 7:
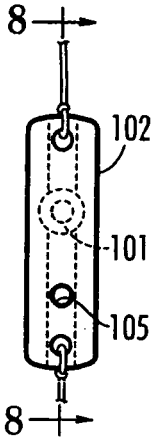
FIG. 7 is a section taken on line 7-7 in FIG. 6.
Figure 8:
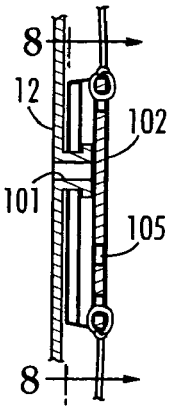
FIG. 8 is a section taken on line 8-8 in FIG. 7.
Figure 9:
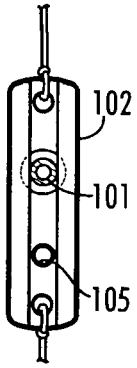
FIG. 9 is a section taken on line 9-9 in FIG. 8.
Figure 6:
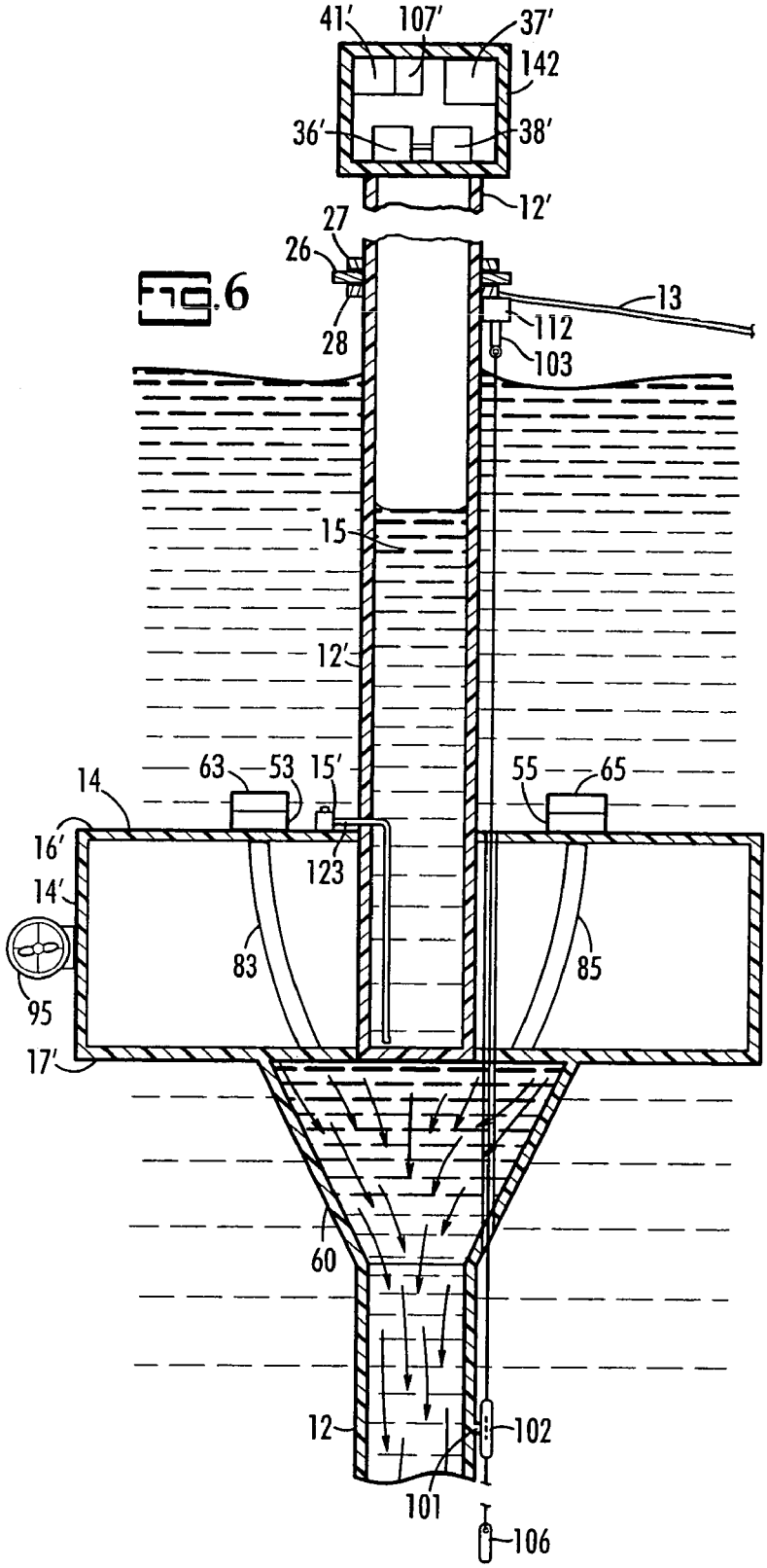
FIG. 6 is a vertical section showing an alternative propulsion feature and an alternate position for the power and control equipment.
Figure 10:
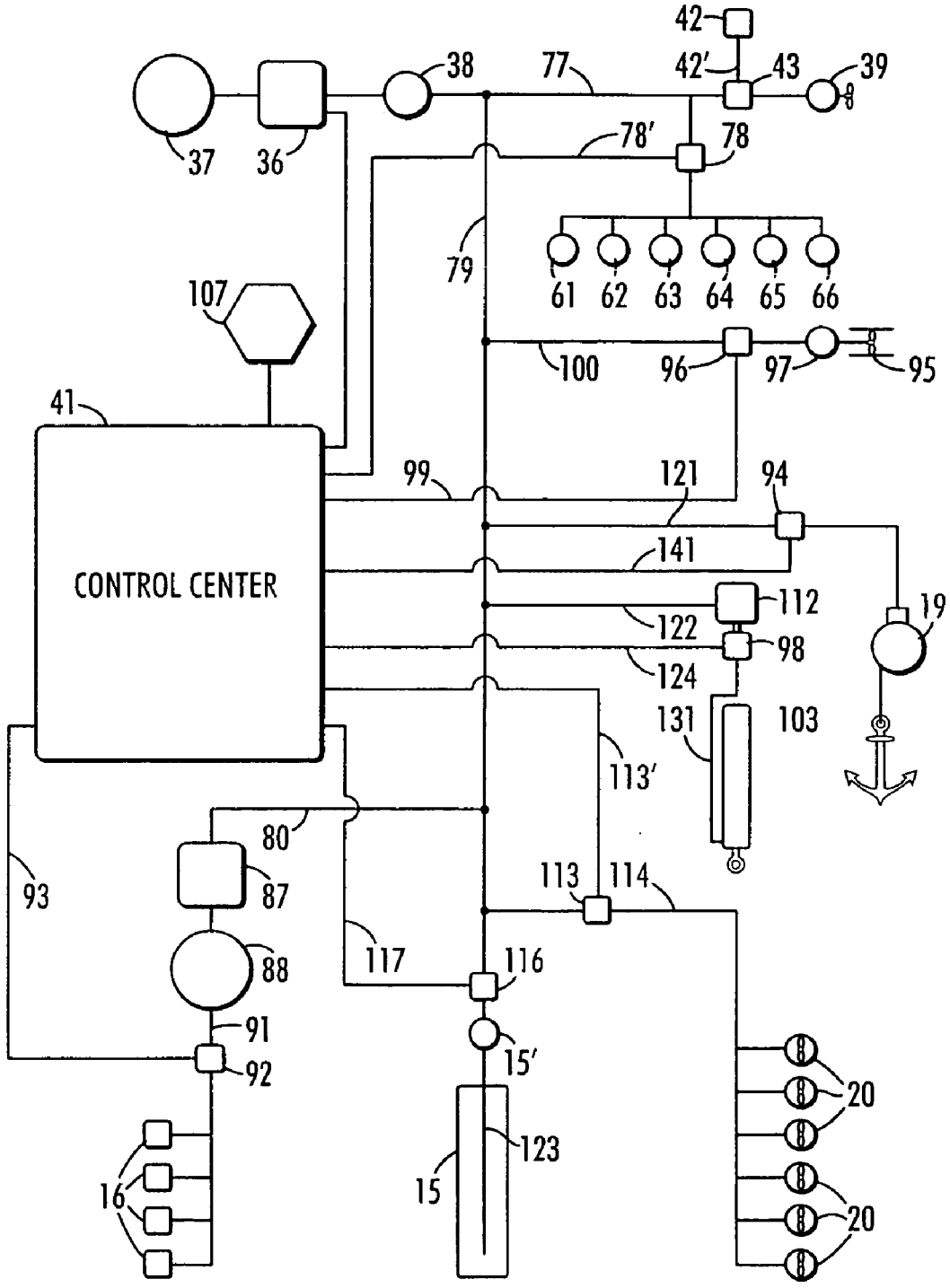
FIG. 10 is a schematic showing of a control system for the apparatus of FIGS. 1 through 9.
Figure 11:
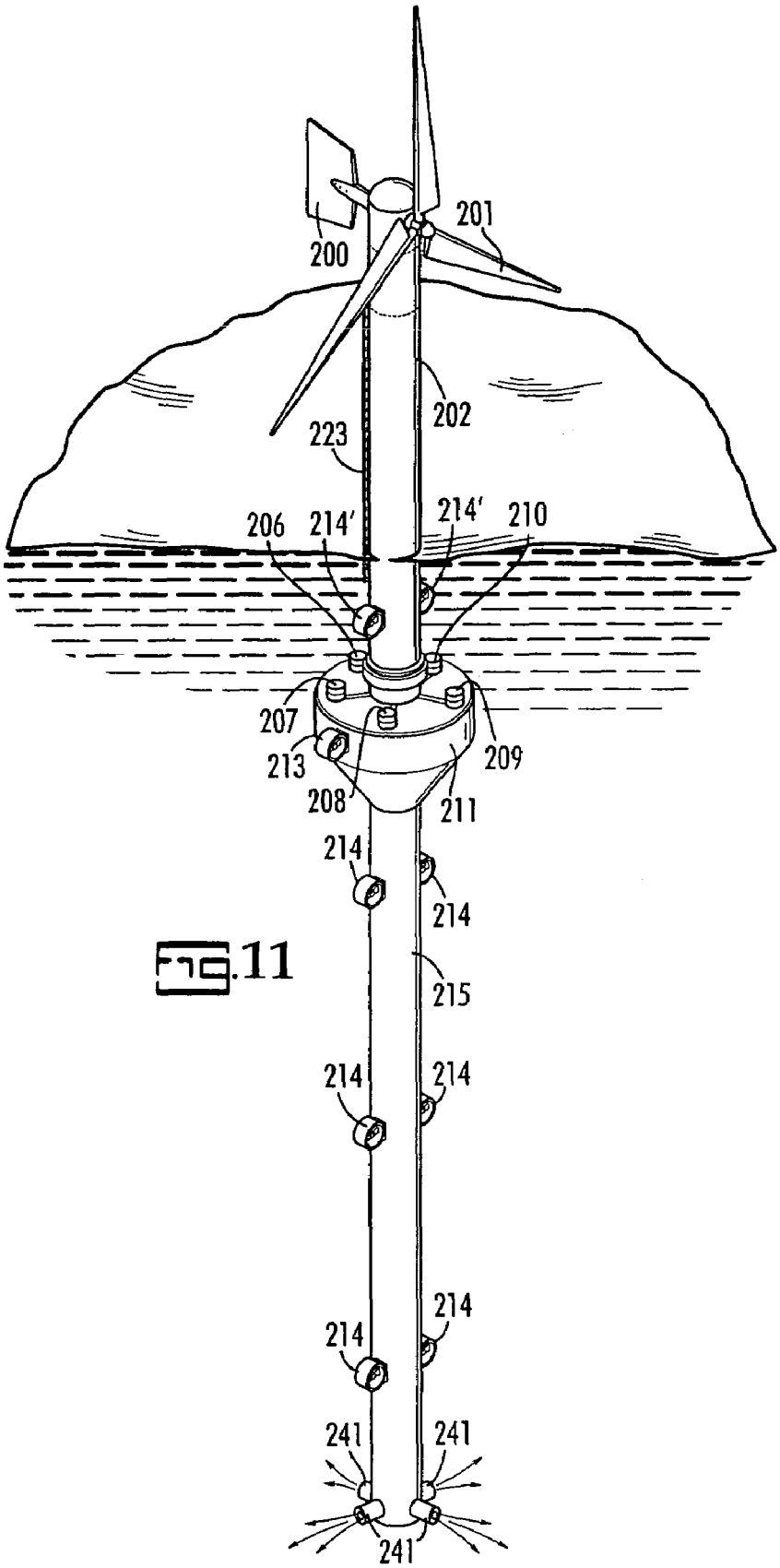
FIG. 11 is a perspective view of a second embodiment of the apparatus for pumping surface water to a predetermined ocean depth.
Figure 12:
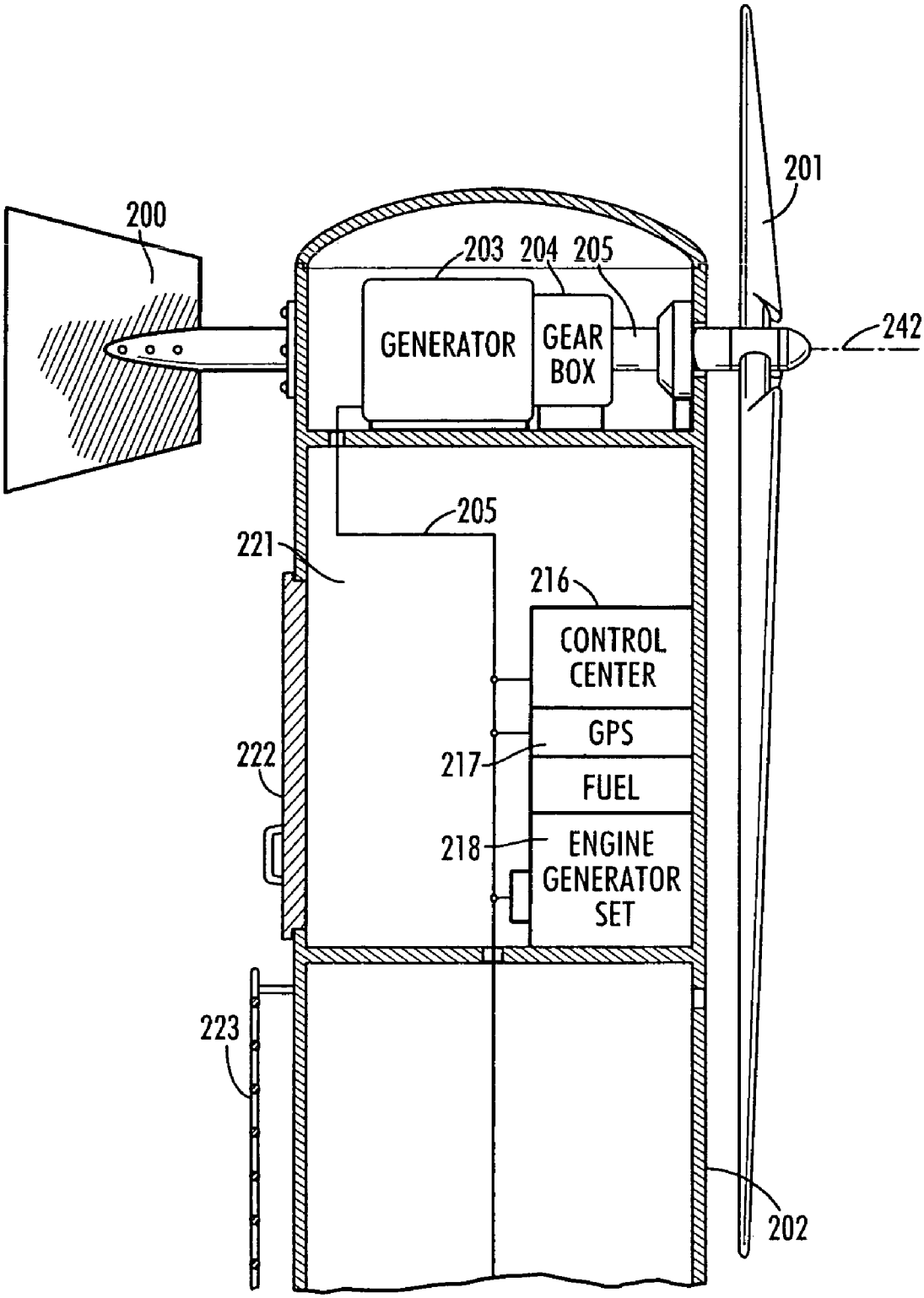
FIG. 12 is a vertical section view of the upper end of the apparatus shown in FIG. 11.
Figure 13:
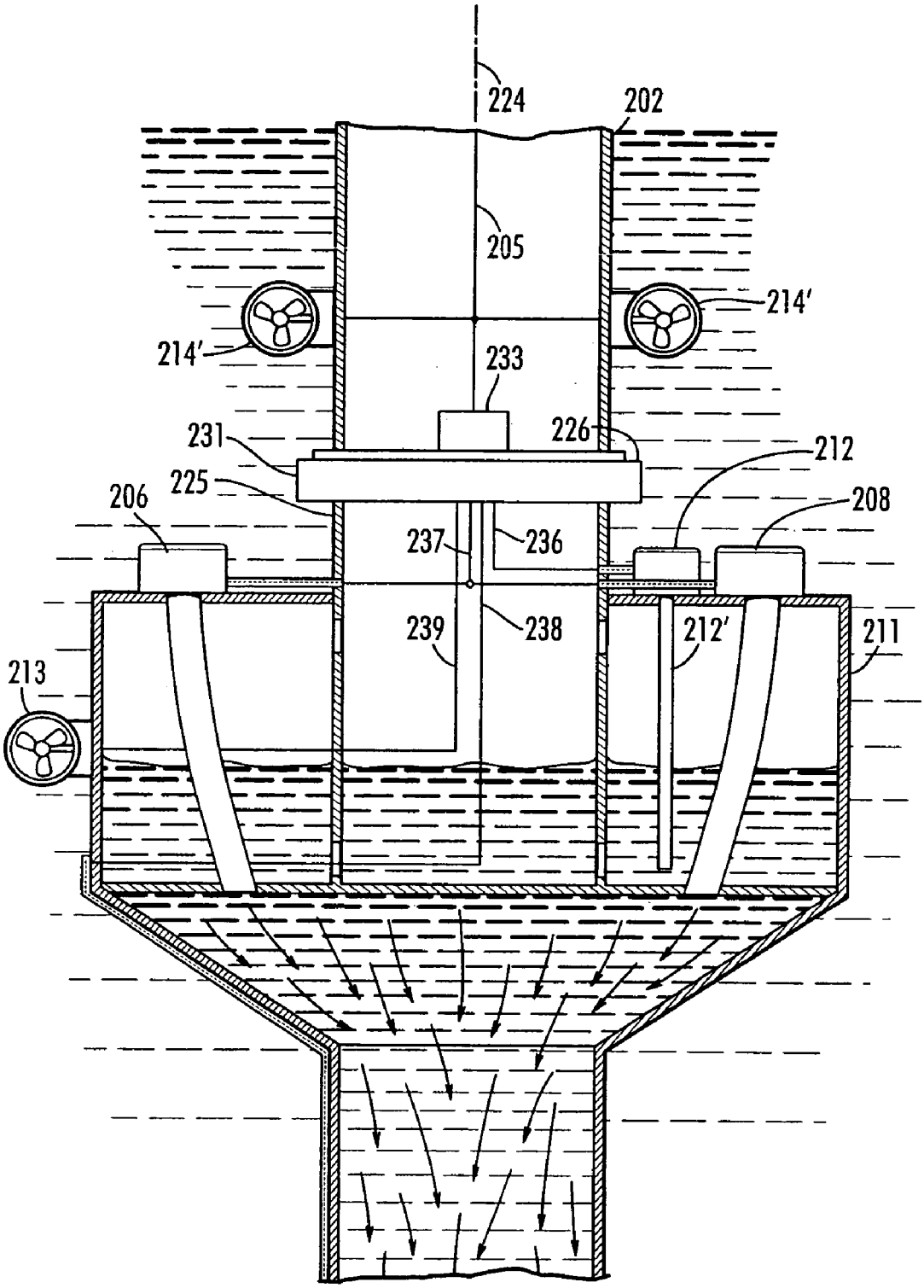
FIG. 13 is a vertical section view of the float tank of the second embodiment.
Figure 14:
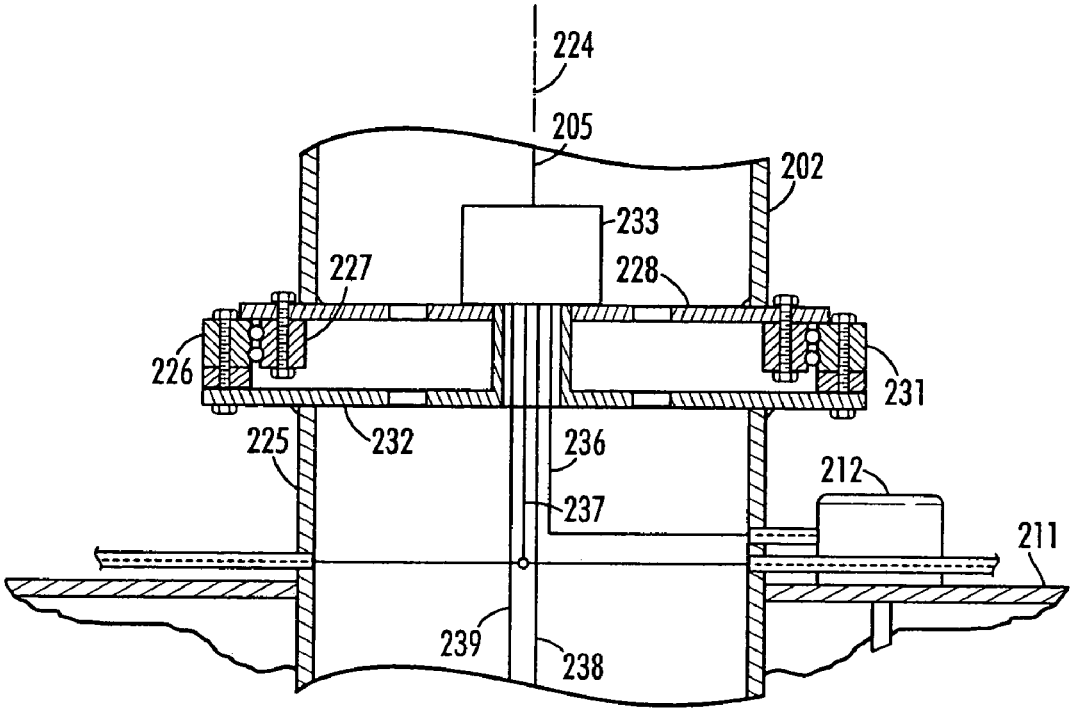
FIG. 14 is a vertical section of the pivot joint in the tube extending upwardly from the float tank.

FIG. 1 shows an apparatus for decreasing the temperature of ocean surface water. An equipment boat 11 is tethered by a painter 13 to an upper cylindrical vertical tube section 12' extending upward from a cylindrical float tank 14, which has a cylindrical side wall 14' and a flat top wall 16'. The tank 14 supports the upper section 12' and also supports a cylindrical main vertical tube or pipe 12 which may have a diameter of 8 to 10 feet and is several hundred feet long. The main tube 12 and the tube section 12' need not be the same diameter. The tube section 12' is concentric with the cylindrical side wall 14' of the tank 14 and includes a portion extending downwardly through an opening in the top wall 16' to the bottom wall 17' of the tank 14, to which it is rigidly secured as by welding. The tube section 12' is aligned with the main cylindrical tube 12, is closed at the bottom of the tank 14 and is closed at its top by a compressed air chamber 88 thereby forming an air chamber 15 in the upper tube section 12'. The amount of air in the air chamber 15 is controlled by a reversible electric motor driven water pump 15' mounted on the tank 14 as shown in FIGS. 5 and 6. The pump 15' moves water to and removes water from the air chamber 15 through a water conveying conduit 123. Air is admitted to the chamber 15 via an opening 30 in the upper tube section 12' just below the compressed air chamber 88. The depth of the tank 14 below the ocean surface can be adjusted by varying the volume of the air in the air chamber 15, such adjustment being made by operating the reversible electric motor driven pump 15', which is mounted on the top wall 16' of the tank 14 and is supplied electric power by a lead 79 as shown in FIG. 10.

A series of vertically spaced air chambers 16 are attached to one lateral side of the main tube 12, which can be filled with air to aid in movement of the apparatus to a different location. Referring also to FIG. 2, four lateral discharge conduits 17 extend radially from the lower end of the main tube 12 so as to discharge the surface water over a wide area to create a lava lamp effect. An anchor 18 for stabilizing the geographic position of the apparatus is suspended from the end of a cable 18' controlled by an electrically powered cable winch 19 which is connected to an electric generator 38 by a lead 79 and a branch lead 121, as shown in FIG. 10. When it is desired to temporarily fix the position of the apparatus the anchor 18 may be lowered by the winch 19, which is controlled by a switch 94 in lead 121 operated by the control center 41 through lead 141. A series of electrically driven propulsion devices 20 with propellers are secured at regular vertical intervals to diametrically opposite sides of the tube 12. The propulsion devices 20 are used to move the apparatus in a controlled manner as will hereinafter be explained in more detail.

Figure 3:
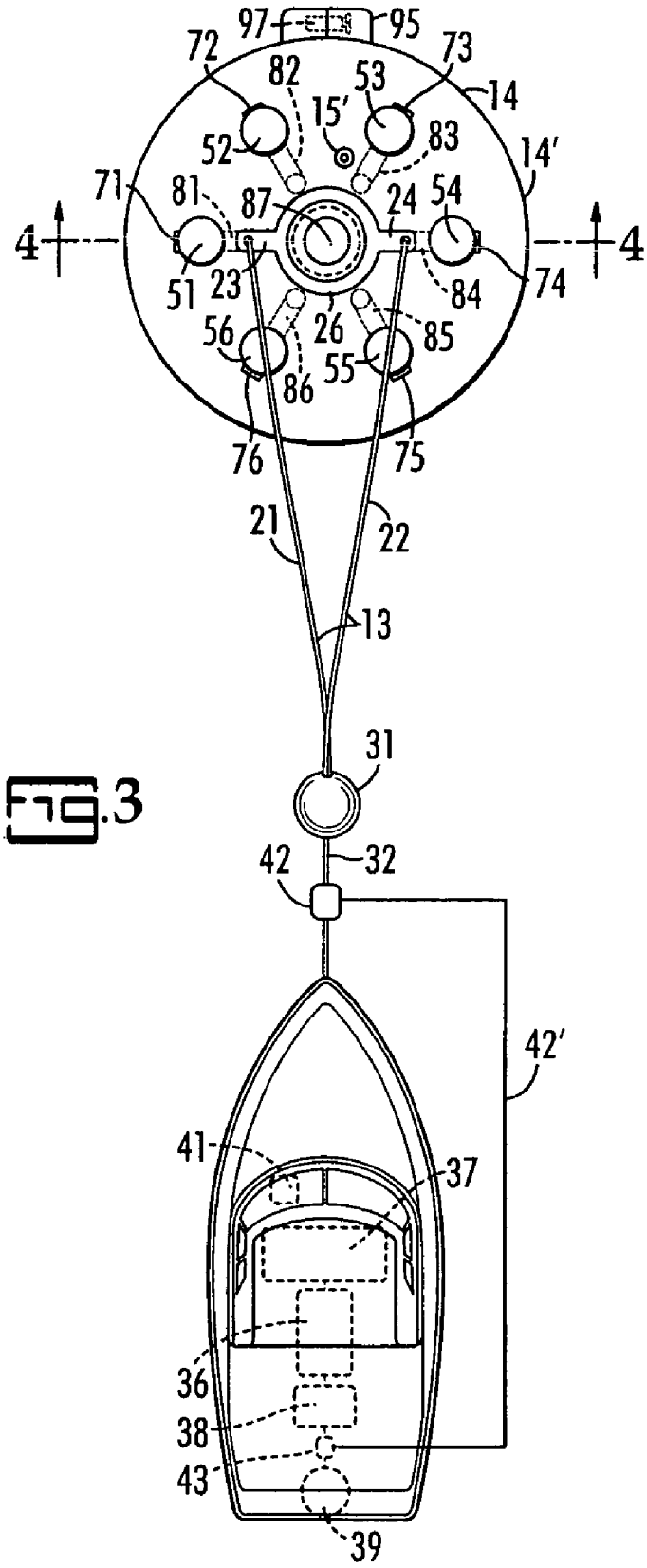
FIG. 3 is an enlarged top view of the apparatus shown in FIG. 1.
Figure 4:
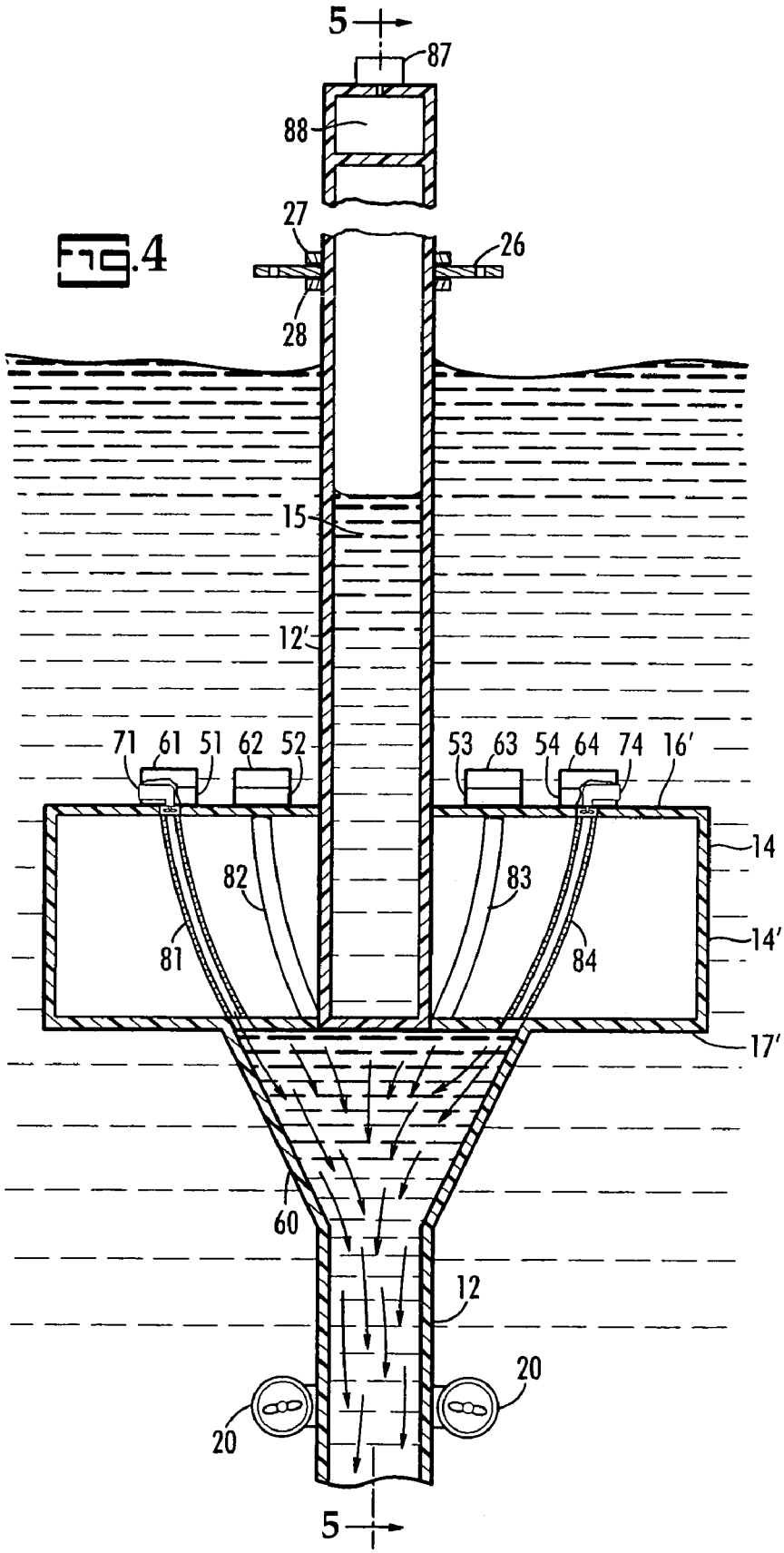
FIG. 4 is a section taken on line 4-4 in FIG. 3.

Referring also to FIGS. 3, 4 and 5, the equipment boat 11 is tethered to the upstanding upper tube section 12' by the painter 13 which has a pair of lines 21, 22 having corresponding forward ends connected to arms 23, 24, respectively, extending radially outward in diametrically opposite directions from a pivot ring 26 pivotally supported on the upper tube section 12' between two axially spaced and radially outward extending parallel horizontal flanges 27, 28 secured to the upper tube section 12'. The rearward ends of the lines 21, 22 are connected to a relatively small float 31 and the float 31 is connected to the equipment boat by a single line 32 of the painter 13. The equipment boat 11 carries an internal combustion engine 36, a fuel tank 37 for the engine 36, an electric generator 38 connected in driven relation to the engine 36, a propulsion unit in the form of a reversible electric motor 39 for propelling the boat 11 and a remotely controlled control center 41. A stress sensor unit 42 is provided in the line 32 and, when the stress in the line 32 reaches a first predetermined value, an electrical signal is sent to a switch 43 through lead 42' to cause reversible electric drive motor 39 to be connected to the output of the generator 38 to automatically drive the boat 11 forward until the stress falls below a second predetermined value. This propulsion of the boat 11 relieves the floating main tube 12 and the tank 14 of the drag otherwise imparted by the boat 11 in high wind conditions. In a calm weather condition excessive slack may develop in the painter 13, giving rise to danger of the painter 13 and the boat 11 becoming entangled with other components of the apparatus. In order to prevent possible entanglement, the stress sensor unit 42 sends an electrical signal to the switch 43 when a predetermined slack condition occurs, thereby causing the motor 39 to drive the boat in a reverse direction until the stress reaches a value indicative of absence of an excessively slack condition of the painter 13. Since the stress in the painter 13 fluctuates due to wave action, the stress sensor unit is provided with a computer program operating to average the sensed stress.

Six main pumps 51, 52, 53, 54, 55, 56 driven by electric motors 61, 62, 63, 64, 65, 66, respectively, are mounted on the top wall 16' of the tank 14 at 60 degree spacing in a circle concentric with the main tube 12 and the tank 14. The six pumps 51, 52, 53, 54, 55, 56 are capable of drawing a high volume of surface, or near surface, water through their radially outward opening inlets 71, 72, 73, 74, 75, 76 and deliver the warm water to the main pipe 12 via conduits 81, 82, 83, 84, 85, 86 and a funnel portion 60 interconnected between the bottom wall 17' of the tank 14 and the main tube 12. As shown in FIG. 10, the electric pump motors 61, 62, 63, 64, 65, 66 are connected to the generator 38 via an electric line 77 and an electric switch 78 controlled by the control center 41 via line 78'.

Referring also to FIG. 10, an electrically driven high pressure air compressor 87 is mounted in the compressed air chamber 88 at the upper end of the upper tube section 12' and is supplied electrical power through a line 79 and a branch line 80. The compressed air storage chamber 88 is supplied compressed air by the compressor 87. Compressed air from the compressed air storage chamber 88 is delivered to the lower air chambers 16 via a conduit 91 and via a solenoid valve 92 controlled by the control center 41 via lead 93, the valve 92 having hold, exhaust and delivery positions of adjustment. Each air chamber 16 is equipped with an air operated valve, not shown, which allows water to escape when supplied pressurized air and allows water to return to the chamber 16 when pressurized air is not delivered to the chamber 16. When the air chambers 16 are filled with air, the main tube 12 will float in a horizontal position, thereby greatly facilitating its towed movement to a different position in the ocean.

An alternate pipe propulsion system is shown in FIGS. 6 through 9. A plurality of vertically spaced exhaust ports 101 are provided on the side of the main tube 12 opposite the side to which the air chambers 16 are secured. The ports 101 are opened and closed by vertical adjustment of the valve plates 102, such adjustment being provided by a single acting linear fluid actuator 103 connected to the valve plates 102 by an operating cable 104. The valve plates 102 are connected in series by short cable segments and a weight 106 is suspended from the bottom valve plate 102 to insure downward adjustment of the valve plates 102. When the plates 102 are adjusted upwardly by the actuator 103, a port 105 in the plate 102 is aligned with the associated opening 101 in the main tube 12, thereby allowing discharge .of water from the main tube 12 through the openings 101. As shown in FIG. 10, the fluid actuator 103 is supplied pressure fluid via a valve 98 and a conduit 131 from an electrically powered fluid pressure supply system 112 including pressure tank, not shown, and an electric motor driven pump, not shown, which is connected to the generator 38 via a branch lead 122. The valve 98 is operated by the control center 41 through a control lead 124. FIG. 6 also shows an alternate location for power and control equipment including an engine 36' driving an electric generator 38', a fuel tank 37', a control center 41' and a global positioning system 107 operatively mounted in a housing 142 secured to the upper end of the upper tube section 12'. This alternate feature may eliminate the need for the equipment boat 11.

When it is desired to make an adjustment of the geographic position of the apparatus, the operator provides a global positioning system 107 with the new location data and the global positioning system 107 provides electronic instructions to the control center 41. The control center 41 through a control line 90 and a switch 96 in a branch lead 100 causes a reversible float turn motor 97 of a propulsion device 95 to orient the float tank 14 and tube 12 in the selected direction. The control center 41, through lead 113' also operates a switch 113 in electric line 114 to cause propelling operation of the propulsion units 20 thereby moving the apparatus to the selected location. If it is desired to move the apparatus a considerable distance the tube 12 may be placed in a horizontal position by delivery of air to chambers 16 to move the main tube 12 to a horizontal position. The apparatus is then towed to a new location by the equipment boat 11 or other boat.

The float tank 14 and the upper tube section 12' are designed so that when a predetermined amount of water is pumped out of the air chamber 15 by the reversible electric motor driven pump 15', effected by operation of a switch mechanism 116, in a lead 79, the top of the tank will rise above the level of the ocean, thereby facilitating service or replacement of the pumps 51-56, the motors 61-66, the pump 15' and other equipment that may be mounted on the tank 14. As shown in FIG. 10, the reversible pump 15' is connected to the generator by lead 79 via switch 116 which is connected to the control center 41 by a lead 117.

FIGS. 11 through 14 illustrate a second embodiment of the water conversion apparatus, in which a large three bladed wind turbine 201, installed near the top of an upper upstanding tube section 202, has a horizontal shaft 205 driving an electric generator 203 through a rotation speed increasing gear box 204. A tail 200 keeps the turbine 201 in facing relation to the wind. The generator 203 supplies electric power via a multistranded electric lead 205 containing electric transmission and control lines to very large water pumps 206, 207, 208, 209, 210 mounted on a float collar or tank 211 and also to a reversible pump 212, to a reversible float tank turn motor of a propulsion device 213 and to the electric motors of propulsion units 214 on the lower tube portion 215. The generator 203 also supplies electrical power to a control center 216, which includes a computer, and a global positioning system 217. A standby or back-up engine generator set 218 is provided in an equipment room 221 at the top of the upper tube section 202 which may be selectively or automatically activated to supply electric power when there is a lack of adequate wind. The backup engine generator set 218 is at least powerful enough to power the control center 216, the global positioning system and the propulsion units 214 below the collar 211. The engine generator set 218 is also equipped with a battery, not shown, for starting its internal combustion engine. The equipment room 202 is accessible by way of a door 222 and a ladder 223 secured to the upper tube section 202. The lower end of the upper tube section 202 is pivotally connected on a vertical pivot axis 224 to an intermediate tube section 225 by a double roller bearing 226 shown in FIG. 14. The bearing is appropriately lubricated and sealed to prevent loss of lubricant and to prevent water entering the tube. An inner raceway 227 is rigidly bolted to a flat annular shaped wall 228 welded to the lower end of the upper tube section 202 and an outer raceway 231 is rigidly bolted to a flat annular shaped wall 232 welded to the upper end of the intermediate tube section 225. The multi-stranded electric lead 205 has multiple lines connected to a stationary part of a rotatory electrical contactor 233 having stationary and rotating slip rings, shown schematically in FIG. 15. A lead 236 connected to the reversible pump 212, a lead 237 connected to the water pumps 206, 207, 208, 209, 210, a lead 238 connected to propulsion units 214 and a lead 239 connected to the float collar mounted propulsion device or unit 213 are connected to the rotating electric slip rings which rotate with the float collar or tank 211.

The pivot connection between the upper tube section 202 of the tube structure and the intermediate tube section 225 permits the wind turbine 201 face the wind, as aided by the tail 200, and permits the lower tube section 215 to be rotated by the propulsion device 213 to face a predetermined desired direction when it is desired to move the apparatus to a different location through operation of the propulsion units 214 on the lower tube section 215. The two propulsion units 214' above the bearing 226 have propellers whose axes are parallel with the axis 242 of the wind turbine 201 and are operated to offset the push of the wind on the wind turbine 201 and the upper tube section 202, thereby helping to maintain the apparatus in the desired upright position in the ocean for generating power to cool the ocean surface temperature. The propulsion units 214, 214' have electric motor driven propellers.

Figure 15:
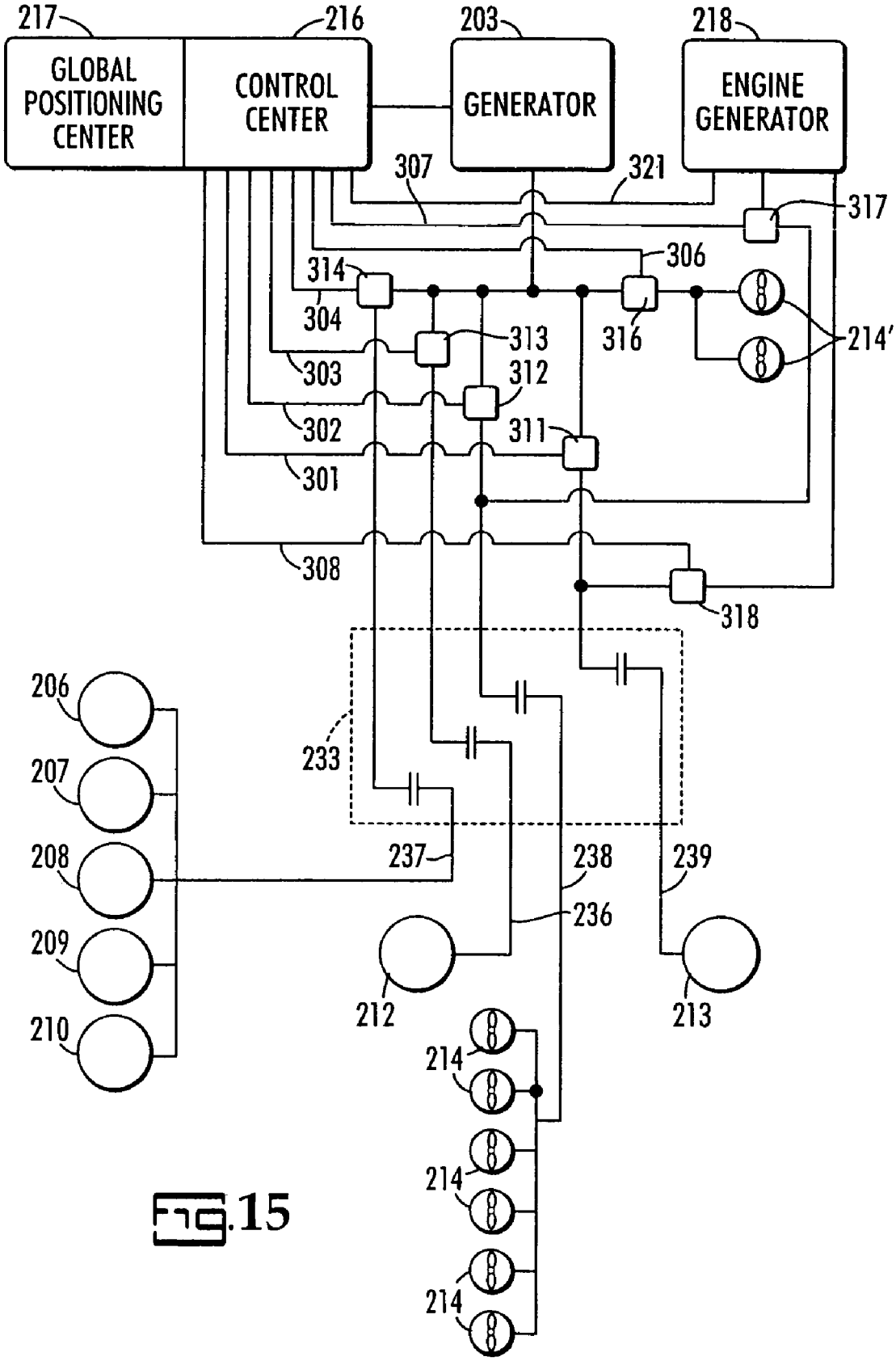
FIG. 15 is a schematic showing of a control system for the apparatus shown in FIGS. 11 through 14.

FIG. 15 is a schematic showing a control system for the embodiment of the invention shown in FIGS. 11 through 14. The control center 216 through leads 301, 302, 303, 304, and switches 311, 312, 313 and 314, controls flow of electric power from the generator 203 to the float rotation propulsion device 213, the propulsion devices 214, the reversible pump 212 and the large pumps 206-210. The control center 216 through lead 306 controls power from the generator 203 to propulsion devices 214' through switch 316. The control center 216 through lead 307 and switch 317 controls power from the engine generator set 218 to the propulsion devices 214, and through lead 308 and switch 318 the control center 216 controls power to the float rotation device 213. The engine generator set also supplies power via lead 321 to the control center 216, its computer and the GPS 217.

The depth of the collar or tank 211 is controlled by the volume of water pumped into and from it by the reversible pump 212. Tough operation of the pump 212 the tank can be brought from its submerged operating position to the ocean surface to facilitate servicing of the pumps 206, 207, 208, 209 and 210. A water conveying conduit 212 extends from the pump 212 to near the bottom of the tank 211.

The herein disclosed marine water conversion apparatus is operable to change the water temperature of a significant ocean surface area. The high volume discharge of warm surface water via discharge conduits 241 on the lower end of the very large diameter lower tube portion 215 in radially outward directions creates a large upwelling of warm water causing large volumes of cooler water to move upward to the ocean surface. Many conversion units will need to be strategically positioned before and during the hurricane season to cover a relatively large area of the ocean through which hurricanes pass or in which hurricanes tend to form, such as the Gulf of Mexico. The global positioning system 217 or GPS in the control center at the top of the tube gives the unit identification and geographic information to a computerized and manned direction center which may be on a boat, on land or in the air. The large surface water removal pumps 81-86 or 206-210 draw a very large volume of water from the ocean surface adjacent the float tank or collar 14, 211. The pump head pressure is a function of the difference in density between the warm surface water and the deep cooler water at the tube discharge. The ocean surface is cooled by the removal of the warm surface water, and more particularly by the upwelling of cooler water created by the large volume of warm water percolating upward from the tube discharge. The radial discharge of the surface water from the circumferentially spaced discharge conduits 17 or 241 causes formation of a lava lamp area producing a lifting effect helping to replace the surface water being removed with cooler water directly beneath the removed surface water. The use of multiple units, properly positioned, can prevent development of a hurricane or greatly reduce its intensity. The use of remote controls to operate the control center avoids the need for stationing personnel on the conversion apparatus.

In addition to advantageously using the marine water conversion apparatus to alter or prevent hurricane development, as annularly occurs in the Caribbean sea, the apparatus can be used to counteract the El Nino warming of the ocean surface off the western coast of South America which occurs every 4 to 12 years, when the upwelling of cold nutrient-rich water does not occur. The water conversion apparatus can also be used to troll ocean currents to skew their path. This last mentioned use has application in cleaning harbors of debris. Use of the herein disclosed water conversion apparatus brings nutrient rich water toward the ocean surface thereby enhancing production of fish and other aquatic animals.

What is claimed is:

1. A marine water conversion apparatus, comprising:

a float tank having side, bottom and top walls, a long vertical cylindrical main tube suspended from said tank and having a lower end with a plurality of radially outward opening outlets, an upstanding cylindrical upper tube section secured to and extending upwardly from said float tank in coaxial relation to said main tube terminating in a closed upper end to form an air chamber, an air vent opening in said air chamber at the upper end of said tube section, a reversible water pump mounted on said tank, a water conveying conduit interconnecting said reversible water pump and the lower end of said air chamber in said tube section, and a plurality of main water pumps mounted on said float tank and connected in water delivery relation to said main pipe, whereby operation of said main water pumps transfers surface water to said outlets at the lower end of said main tube, said apparatus being positionable at predetermined locations in an ocean wherein said float tank is disposed below the ocean surface when air fills a first predetermined portion of said air chamber in said tube section and wherein said top wall of said float tank is disposed above the ocean surface when water fills a second predetermined portion of said air chamber in said tube section.

2. The apparatus of claim 1 having a series of vertically spaced propulsion devices on said main tube operable to move said apparatus to a predetermined location in said ocean.

3. The apparatus of claim 2 wherein said propulsion devices include electrically driven propellers.

4. The apparatus of claim 2 wherein each of said propulsion devices includes a pair of electrically driven propellers on diametrically opposite sides of said main tube.

5. The apparatus of claim 1 having a plurality of vertically spaced air chambers secured to said main tube, a source of compressed air and control means for selectively delivering air to all of said chambers and for replacing said air with water in all of said chambers.

6. The apparatus of claim 1 having an equipment boat connected to said upper tube section by a painter, a stress sensor in said painter, an electrically powered propulsion unit in said boat, a source of electricity in said boat, a control for connecting said propulsion unit to said source of electricity including a switch, said sensor being connected in signal delivery relation to said switch to cause said switch to connect said source of electricity to said propulsion unit to cause the boat to be propelled in a forward direction when the stress sensed by said sensor exceeds a maximum predetermined value.

7. The apparatus of claim 6 wherein said switch causes said source of electricity to be connected to said propulsion unit to cause said boat to be propelled in a rearward direction when the stress sensed by said sensor falls below a minimum predetermined value.

8. The apparatus of claim 1 having a propulsion device on a said side wall operable to rotate said float tank.

9. A marine water conversion apparatus, comprising:

a cylindrical float tank having a flat top wall, a cylindrical side wall and a bottom wall, a relatively long main vertical cylindrical tube having a lower end with a plurality of radially outward opening outlets, and a top end having an upward diverging conically shaped funnel rigidly secured at its top to said bottom wall of said tank in coaxial relation to said cylindrical side wall, an annular opening in said top wall of said tank aligned with said main tube, an upstanding cylindrical tube section concentric with said main tube extending upwardly through said annular opening in said top wall of said float tank and rigidly secured at its lower end to said bottom wall of said tank, said tube section extending a substantial distance above said tank and terminating in a closed upper end to form an air chamber, an opening in said upper end of said tube section forming an air vent in said air chamber, a reversible water pump mounted on said top wall of said tank, a water conveying conduit interconnecting said reversible water pump and the lower end of said air chamber in said tube section, and a plurality of main water pumps mounted in circumferentially spaced relation to one another on said top wall of said float tank, said main water pumps having surface water intakes and being connected in water delivery relation to said funnel, whereby operation of said main water pumps transfers surface water to said outlets at the lower end of said main tube, when said apparatus is placed in an ocean, said apparatus being positionable at predetermined locations in said ocean wherein said float tank is disposed below the ocean surface when air fills a first predetermined portion of said air chamber in said tube section and wherein said top wall of said float tank is disposed above the ocean surface when water fills a second predetermined portion of said air chamber in said tube section.

10. The apparatus of claim 9 having a series of vertically spaced propulsion devices on said main tube operable to move said apparatus to a predetermined location in said ocean.

11. The apparatus of claim 10 wherein said propulsion devices include electrically driven propellers.

12. The apparatus of claim 10 wherein each of said propulsion devices includes a pair of electrically driven propellers on diametrically opposite sides of said main tube.

13. The apparatus of claim 10 wherein propulsion devices are a plurality of vertically spaced and vertically aligned openings from which water discharge is controlled by individual plate valves operated simultaneously.

14. The apparatus of claim 9 having a plurality of vertically spaced air chambers secured to said main tube, a source of compressed air and control means for delivering air to all of said chambers and for replacing said air with water in all of said chambers.

15. The apparatus of claim 9 having an equipment boat connected to said tube section by a painter, a stress sensor in said painter, an electrically powered propulsion unit in said boat, a source of electricity in said boat, a control for connecting said propulsion unit to said source of electricity including a switch, said sensor being connected in signal delivery relation to said switch to cause said switch to connect said source of electricity to said propulsion unit to cause the boat to be propelled in a forward direction when the stress sensed by said sensor exceeds a maximum predetermined value.

16. The apparatus of claim 15 wherein said switch causes said source of electricity to be connected to said propulsion unit to cause said boat to be propelled in a rearward direction when the stress sensed by said sensor falls below a minimum predetermined value.

17. The apparatus of claim 9 having a propulsion device on said float tank operable to rotate said float tank.

18. A marine water conversion apparatus for pumping surface water of the ocean several hundred feet beneath the ocean surface, comprising:

a float tank having top, bottom and side walls, a long main vertical tube having an upper end rigidly secured to said bottom wall and a lower end with a plurality of radially outward opening outlets, an upstanding tube section having a lower end rigidly secured to said tank, said upstanding tube section having closed upper and lower ends to form an air chamber and an air vent for said air chamber near the upper end of said tube section, a reversible water pump supported by said tank, a water conveying conduit interconnecting said reversible water pump and said air chamber, a plurality of main water pumps mounted on said tank having ocean surface water intakes, said main water pumps being connected in water delivery relation to said upper end of said main vertical tube, propulsion devices operable to propel said apparatus in said ocean, and a remote control system for said pumps and said propulsion equipment including a global positioning system operable to move said apparatus to selected locations in said ocean.

19. The apparatus of claim 18 wherein said float tank is disposed below the ocean surface when at least a first predetermined portion said air chamber of said tube section is filled with water and wherein said float tank is disposed at the surface of said ocean when at least a second predetermined portion of said air chamber of said tube section is filled with air.

20. The apparatus of claim 18 having computer programs in said remote control system for causing said apparatus to move in predetermined grid patterns.

21. The apparatus of claim 18 having computer programs in said remote control system for causing said apparatus to move in predetermined circular patterns.

22. The apparatus of claim 18 including a generator, an engine drivingly connected to said engine, a control center and a global positioning system operatively positioned in a housing secured to the upper end of said tube section.

23. A marine water conversion apparatus, comprising:

a float tank having side, bottom and top walls, forming an air chamber, a long vertical cylindrical main tube suspended from said tank and having a lower end with a plurality of radially outward opening outlets, an upstanding cylindrical upper tube section pivotally connected on the axis of said tube to and extending upwardly from said float tank in coaxial relation to said main tube, said upper tube section terminating in a closed upper end to form an air chamber, an electrical generator at the upper end of said upper tube section, a wind turbine mounted on said upper end of said upper tube section and drivingly connected to said generator, a control room near the top of said upper tube section, a reversible water pump mounted on said tank, a water conveying conduit extending between said reversible water pump and a low part of said float tank, and a plurality of main water pumps mounted on said float tank and connected in water delivery relation to said main tube, whereby operation of said main water pumps transfers surface water to said outlets at the lower end of said main tube, said apparatus being positionable at a predetermined location in an ocean wherein said float tank is disposed below the ocean surface when a predetermined amount of water is in said float tank and wherein said top wall of said float tank is disposed above the ocean surface when water is removed from a predetermined portion of said float tank.

24. The apparatus of claim 23 having a series of vertically spaced propulsion devices on said main tube operable to move said apparatus to a selected location in said ocean.

25. The apparatus of claim 24 wherein said propulsion devices include electrically driven propellers.

26. The apparatus of claim 24 wherein each of said propulsion devices includes a pair of electrically driven propellers on diametrically opposite sides of said pipe.

27. The apparatus of claim 23 having a pair of propulsion devices disposed on diametrically opposite sides of the lower end of said upper tube section operable to supply propulsion thrust in the direction said wind turbine is facing.

28. The apparatus of claim 23 having a propulsion device on a side wall of said float tank operable to rotate said float tank.

29. The apparatus of claim 28 including a rotary electrical contactor mounted at the lower end of said upper tube section in concentric relation to said upper tube section, said switch having stationary and rotating slip rings, a main electrical transmission conduit with multiple leads extending from said generator and control room to said stationary contactors of said switch, leads extending from said rotating slip rings to said main pumps, said reversible pump, said propulsion device on said sidewall of said float tank and said propulsion devices on said main tube, respectively.

30. A marine water conversion apparatus for pumping surface water of the ocean several hundred feet beneath the ocean surface, comprising:

a float tank having top, bottom and side walls, a long main vertical tube having an upper end rigidly secured to said bottom wall and a lower end with a plurality of radially outward opening outlets, an upstanding upper tube section having a lower end secured to said tank, said upper tube section having a closed upper end to form an air chamber and an air vent for said air chamber near the upper end of said upper tube section, said upper tube section being a fluid communication with said float tank, a reversible water pump supported by said tank, a water conveying conduit interconnecting said reversible water pump and said float tank, a plurality of main water pumps mounted on said tank having ocean surface water intakes, said main water pumps being connected in water delivery relation to said upper end of said main vertical tube, propulsion devices on said main tube operable to propel said apparatus in said ocean, and a remote control system for operating said pumps and said propulsion devices.

* * * * *